United States Patent [19]

Maekawa et al.

[11] Patent Number: 4,852,685

[45] Date of Patent: Aug. 1, 1989

[54] DRIPPING SOUND GENERATING APPARATUS

[75] Inventors: Kengo Maekawa, Tokoname; Moitsu Suzuki; Yukiya Nakano, both of Aichi; Hisahiko Tani, Aichi, all of Japan

[73] Assignee: Kabushiki Kaisha Asaplan, Tokyo, Japan

[21] Appl. No.: 200,621

[22] Filed: May 31, 1988

[51] Int. Cl.[4] ..... G10K 11/00

[52] U.S. Cl. ..... 181/175

[58] Field of Search ..... 181/175, 198, 233; 84/1

[56] References Cited

U.S. PATENT DOCUMENTS 2,846,020 8/1958 Crowley ..... 181/175

3,782,497 1/1974 Bidwell et al. ..... 181/233

*Primary Examiner*—B. R. Fuller

*Attorney, Agent, or Firm*—W. Edward Johansen; Kenjiro Hidaka

[57] ABSTRACT

A dripping sound generating apparatus which comprises a dripping sound echoing or resonating member having a cavity inside and a hole at least at the top portion of the member. The apparatus is adapted to allow liquid to enter the member and positively retain the liquid at a lower inside portion of the member. The apparatus also includes a dripping device for producing liquid drops and permitting the liquid drops to fall from the top portion of the member onto a pool of the liquid retained at the lower inside portion of the member and a device for recycling the liquid having dripped for repeated dripping. The apparatus is capable of providing varied dripping sounds over a long time by controlling the amount of the dripping liquid.

12 Claims, 6 Drawing Sheets

DRIPPING SOUND GENERATING APPARATUS

BACKGROUND OF THE INVENTION a. Field of the Invention

This invention relates to a dripping sound generating apparatus which makes liquid to fall in the form of drops onto a surface of liquid pool retained below and makes dripping sounds by the liquid drops when they hit the liquid surface, allowing the sounds to echo or resonate to generate sounds like of "koto (Japanese harp)".

b. Description of Prior Art

There has been known a gardening technique characteristic of Japanese gardens, a so-called "Suikin-kutsu" (water-harp cave) which produces graceful and tasteful sounds which will be echoed in the gardens. Referring to FIG. 7 (Prior Art), this traditional "Suikin-kutsu" is formed by a bowl-like member 1 such as a pot, urn, etc. having a small hole at its bottom. The bowl-like member is buried upside down in the ground near, for example, a washbasin 20 set at an entrance to a tea arbor, so that the water used for washing hands may be allowed to gradually flow into the buried bowl-like member 1 through the hole and to fall as drops onto the surface of water pool retained at a lower portion of the bowl-like member 1, echoing or resonating the sounds by drops within the member 1.

As described above, "Suikin-kutsu" is an arrangement for enjoying sounds generated by water when dripping water hits the surface of water. Therefore, it is very important to make the water fall in the form of drops onto the water surface. For this purpose, a number of pebbles 21 are placed above the hole 2 of the bowl-like member 1 and through a water path to the hold 2 of the bowl-like member 1 to linger and retard the flow of the water and impart a time lag in the water flow so that an excessive quantity of the water may not flow into the bowl-like member 1 at once.

However, this conventional technique can not impart sufficient a time lag to the water flow and, therefore, the water runs out within a short time and the dripping sounds can be enjoyed only within a limited time. Further, if an amount of the water is increased, it becomes impossible to control the water flow. In addition, the quantity of the water of the water pool can not positively be controlled because the water tends to soak into the ground.

Furthermore, since a position from which water flows into the bowl-like member is fixed, the water drops always to the same point. This makes the dripping sounds rather monotonous.

The conventional "Suikin-kutsu" has another disadvantage in that it requires a considerably large space in a garden to install the "Suikin-kutsu" therein. Moreover, in order to enjoy subtle, faint sounds by "Suikin-kutsu", the place to install Suikin-kutsu in should be quiet.

However, it is sometimes difficult to acquire that suitable place for installing Suikin-kutsu in.

SUMMARY OF THE INVENTION

The present invention has been made with a view to solving the problems involved in the conventional technique, and it is an object of the present invention to provide a dripping sound generating apparatus which is capable of providing sufficient time lag to water flow or water supply, or controlling the production of water drops to make the water dripping last longer, while giving a variety to the dripping sounds.

It is another object of the present invention to provide a dripping sound generating apparatus for providing faint and delicate water harp sounds which is especially suited to be set indoors.

It is still another object of the present invention to provide a dripping sound generating apparatus which is capable of recycling the water having dripped for repeated dripping.

The present invention features a dripping sound generating apparatus which comprises a dripping sound echoing or resonating member having a cavity inside and a hole at least at a top portion of the member and adapted to allow water to enter and retain the water at a lower inside portion of the member; a dripping means producing liquid drops and permitting the liquid drops to fall from the top portion of the member onto the liquid retained at the lower inside portion of the member; and means for recycling the water having dripped.

In the apparatus, the dripping sound echoing or resonating member preferably comprises a bowl-like member having a hole in the bottom thereof, which bowl-like member is laid face down for use.

Preferably, liquid paths communicating with said hole on the top portion of the dripping sound echoing or resonating member are formed partly on or all over an outer surface of the top portion of the member said liquid paths causing retardation in the water flow to said hole, thereby forming water drops on the inside surface of the top portion of the dripping sound echoing or resonating member.

Alternatively, liquid paths communicating with said hole on the top portion of the dripping sound echoing or resonating member are preferably formed partly on or all over an inner surface of the top portion of the member. The liquid paths disperse and spread the water entering through said hole onto the inner surface of the dripping sound echoing or resonating member.

The hole on the top portion of the dripping sound echoing or resonating member has a rounded circumferential edge to guide the water into the member surely and easily.

In the case where the dripping sound echoing or resonating member is formed by a bowl-like member, the opening portion of the bowl-like member is received by a tray to hold water at a lower inside portion of the dripping sound echoing or resonating member and the water thus held is circulated to be dripped again from the top portion of the echoing or resonating member.

In a preferred mode, the apparatus of the present invention further comprises means provided at the hole of the top portion of the dripping sound echoing or resonating member for diffusing the dripping sounds thereby. This sound diffusing means is preferably made of a mesh.

In another preferred embodiment of the present invention, the dripping means comprises a circulating pump having an suction inlet at the lower inside of the dripping sound echoing or resonating member and delivery outlet at an upper portion of the member. In this embodiment, water is dripped through the hole of the member.

Alternatively, the dripping means comprises an electric heater panel. In this case, water vapor is produced inside the dripping sound echoing or resonating member by the electric heater panel and the produced water vapor is condensed on the inner surface of the member to become water drops.

DESCRIPTION OF EMBODIMENTS

Figure 1:
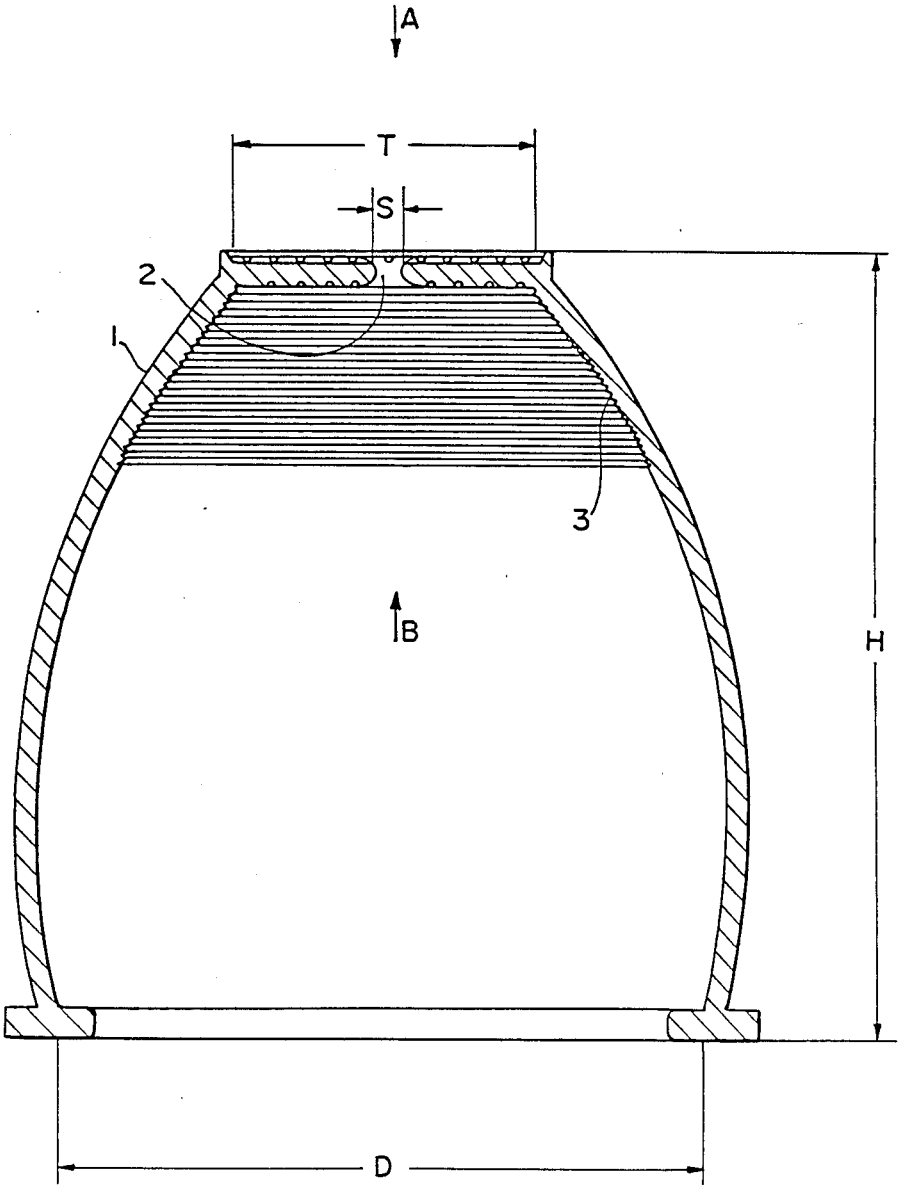
FIG. 1 is a vertically sectional view of one form of a dripping sound generating apparatus embodying the present invention.

The invention will now be described, while referring to the drawings.

Figure 2:
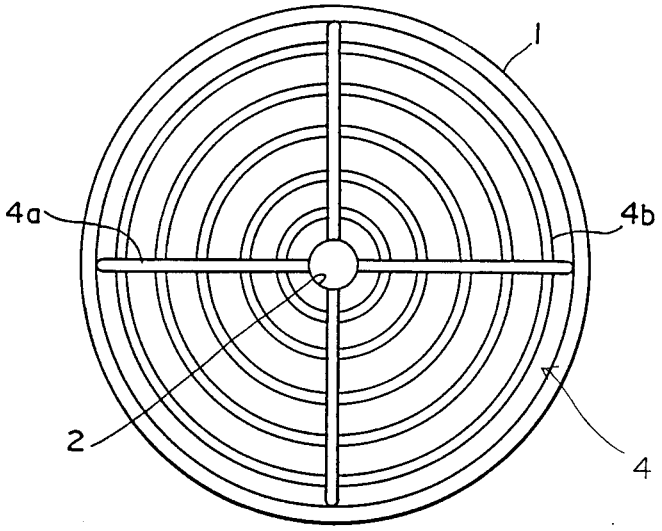
FIG. 2 is an enlarged top view of the dripping sound generating apparatus of FIG. 1 as viewed in the direction of arrow A shown in FIG. 1.
Figure 3:
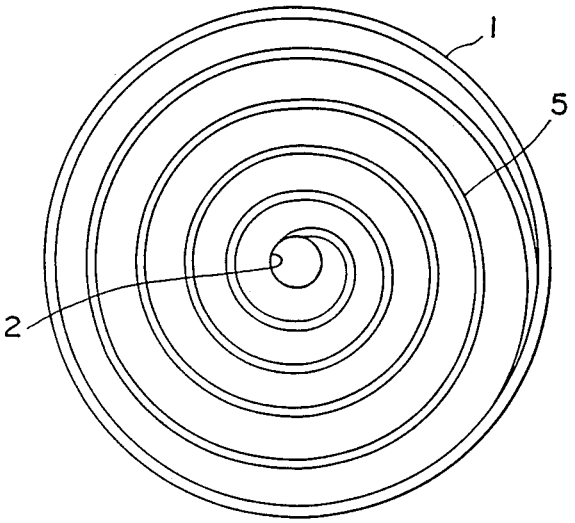
FIG. 3 is an enlarged view of the dripping sound generating apparatus of FIG. 1 as viewed in the direction of arrow B shown in FIG. 1.

FIGS. 1 to 3 illustrate a first embodiment of the present invention.

In the figures, 1 is a dripping sound echoing or resonating member. The dripping sound echoing or resonating member 1 comprises, for example, a bowl-like member such as a bowl, urn, pot, or the like, made of calcined china, pottery, ceramics, glass, or metal. Preferably, unglazed pottery is employed. The numeral 2 denotes an inlet hole provided centrally in a bottom of the bowl-like member 1. The bowl-like member 1 is laid face down. Therefore, in use, the bottom of the bowl-like member 1 is laid upward and the inlet hole 2 is also situated upside to allow water to enter the bowl-like member 1 through the hole 2.

The size of the bowl-like member 1 is not critical and the member 1 may be formed in any suitable size. However, the member 1 is preferably formed in a shape of dome having a height H of 40 to 60 cm, an open end diameter D of 45 to 55 cm, and a bottom diameter T of 20 to 30 cm. The inlet hole 2 has a diameter S preferably of 2 to 3 cm.

The bowl-like member 1 may preferably have a corrugated inner surface partly on or all over the inside wall of the bowl-like member 1. In the embodiment as illustrated, the corrugated inner surface is formed on the inside wall of the bowl-like member 1 in the vicinity of the bottom. This corrugated inner surface ensures holding of the water to the inner surface of the bowl-like member 1 to moisten the entire inner surface of the member. This will improve the tone of the dripping sounds and enhance an echoing or resonating effect.

FIG. 2 illustrates liquid paths 4 provided on an outer surface of the bottom of the bowl-like member 1, or a top face of the bowl-like member 1 laid upside down. The liquid paths 4 comprise main liquid paths 4*a* leading radially to the inlet hole 2 and branch liquid paths 4*b* formed concentrically with the inlet hole 2, intersecting the main paths 4*b*. Each of the branch liquid paths 4*b* communicates with the main liquid paths 4*a*.

The configuration of the liquid paths 4 is not limited to that as illustrated and the paths 4 may be formed in any suitable shape as far as they can linger the liquid flow to cause a desired time lag in the flow and they can guide the water to the inlet hole 2 from different directions.

FIG. 3 is a plan view showing a liquid path 5 formed on the ceiling inside the bowl-like member 1 laid face down. This liquid path 5 is formed in a spiral ground around the inlet hole 2. The configuration of the liquid path 5 is not limited to that of FIG. 3 and the path 5 may alternatively be formed in any suitable configuration as far as such configuration causes the water having the entered the member 1 through the inlet hole 2 to be widely spread, dispersed and held on the inner surface of the bottom and the side wall.

Both of the liquid paths 4 and the liquid path 5 are not always needed for the bowl-like member 1 of the present invention. Either of the liquid paths 4 or 5 may be formed partially at a portion around the inlet hole 2.

The inlet hole 2 has a rounded circumferential edge so that the water coming to the inlet hole 2 may be easily guided onto the inner surface of the bottom of the bowl-like member 1 (the ceiling of the dripping sound echoing or resonating member).

With the dripping sound generating apparatus so arranged, the water supplied to the apparatus lingers in the liquid paths 4 and flows into the apparatus little by little for an extended time. The water entering through the inlet hole 2 is guided onto the inner surface of the bottom of the bowl-like member 1 (the ceiling of the dripping sound echoing or resonating member). Along the rounded edge of the inlet hole 2 and further led widely to the inner surface of the bottom or side wall of the member 1 through the liquid path 5. As a result of this, water drops continue to fall from a wide inside area of the member 1 for a long time. Thus, varied dripping sounds are generated for a long time.

Figure 7:
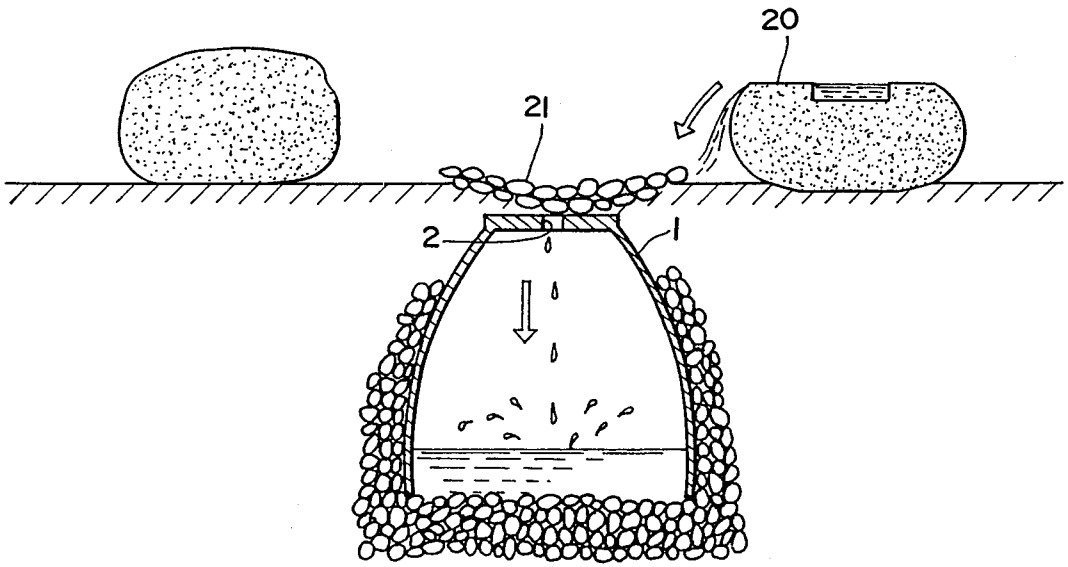
FIG. 7 PRIOR ART
FIG. 7 is a schematic view showing a conventional dripping sound generating apparatus.

In use, the dripping sound generating apparatus of the present invention may be buried under the ground in a manner similar to the conventional water harp as illustrated in FIG. 7 or it may be placed indoors together with a liquid circulating system as will be described in detail later.

Figure 4:
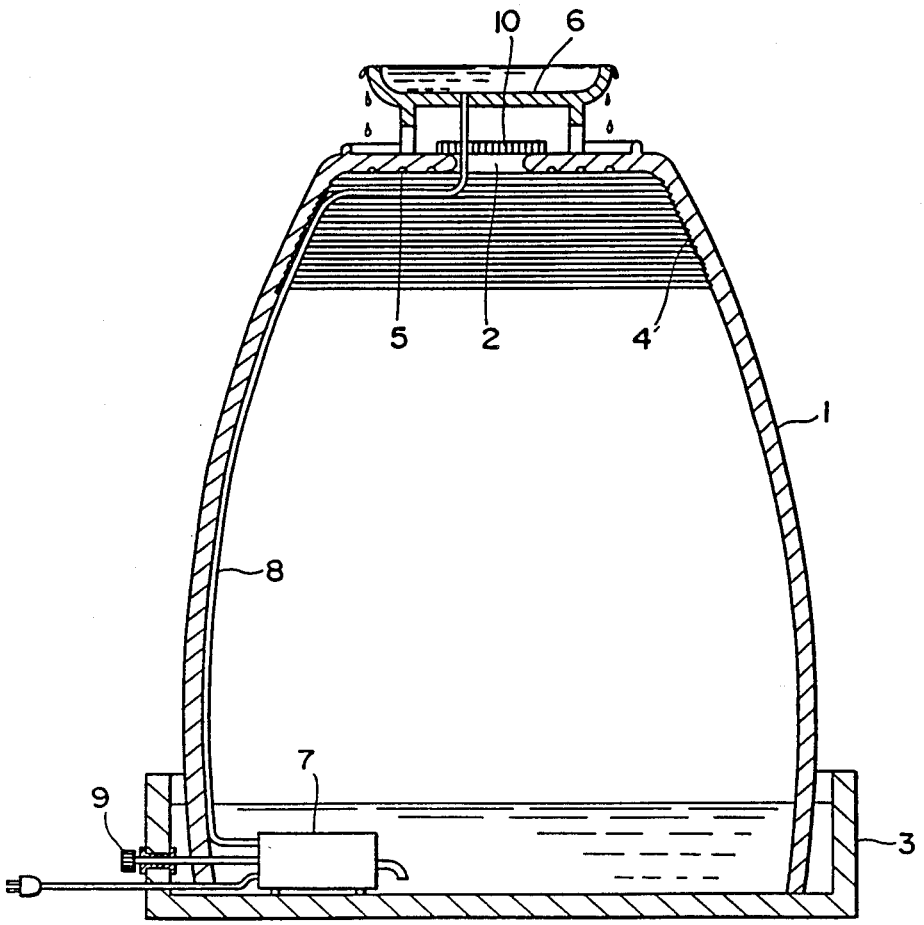
FIG. 4 is a vertically sectional view of another form of a dripping sound generating apparatus embodying the present invention.

FIG. 4 illustrates a second embodiment of the present invention. In the figure, the same or like parts or portions to those of FIGS. 1 to 3 are denoted by same numerals.

In this embodiment, the dripping sound or echoing or resonating member 1 comprises a bowl-like member made, for example, of calcined china, ceramics, pottary, glass, or metal as in the first embodiment. The bowl-like member 1 is preferably made of unglazed pottery. The numeral 2 denotes an inlet hole provided centrally in a bottom of the bowl-like member 1. The inlet hole 2 also functions as a sound emitting hole. The bowl-like member 1 is laid face down. Therefore, in use, the bottom of the bowl-like member 1 is laid upward and the inlet hole 2 also is situated upside to allow water to enter the bowl-like member 1 therethrough and allow the sound generated to emit therethrough. A tray 3 for retaining water is provided under the bowl-like member 1.

The size of the bowl-like member 1 is not critical and the member 1 may be formed in any suitable size. However, the member 1 is preferably formed in a shape of a dome having a height of 30 to 60 cm, an open end diameter of 20 to 40 cm, a bottom diameter of 20 to 30 cm and having the hole 2 of 25 to 30 mm in diameter.

The bowl-like member 1 may preferably have a corrugated inner surface 4' partly on or all over the inside wall of the bowl-like member 1. This corrugated inner surface 4' serves to let the water hold to the inner surface of the bowl-like member 1, moistening the entire inner surface of the member 1 to improve the tone of the dripping sounds and enhance an echoing or resonating effect. However, the inner surface of the bowl-like member 1 may alternatively be smooth.

A liquid path 5 is formed on a ceiling of the bowl-like member 1 laid face down. This liquid path 5 is formed in a spiral around the inlet hole 2. The liquid path 5 functions to spread or disperse water entering through the inlet hole 2 so that the water entering through the inlet hole 2 may be held on the inner surface of the bottom and the side wall.

The hole 2 has a rounded edge so that the water coming to the inlet hole 2 may be easily guided onto the inner surface of the bottom of the bowl-like member 1 (the ceiling of the dripping sound echoing or resonating member).

The numeral 6 denotes a liquid tank or reservoir provided above the bowl-like member 1 for retaining liquid, usually water, therein. The numeral 7 denotes a pump provided at a lower portion of the bowl-like member 1 for pumping up the water and the numeral 8 denotes pipe through which the liquid tank 6 communicate with the pump 7.

The water is primarily introduced into the bowl-like member 1 and retained at the bottom portion thereof. The water is sucked by the pump 7 up to the liquid tank 6 and then allowed to overflow from the water 6 and flow into the inside of the bowl-like member 1 through the hole 2. At this time, the liquid entering the bowl-like member 1 drips on the pool of the water retained at the bottom portion of the bowl-member 1, generating dripping sounds. The so dripped water is accumulated in the pool of the water retained at the bottom portion of the bowl-like member 1 and again sucked up by the pump 7. Thus, the liquid tank 6, pump 7 and pipe 8 constitute a liquid circulating system which cyclically circulates the water of the pool to drip the water repeatedly in the form of drops. The tap liquid reservoir employable in the present embodiment is not limited to the configuration of the liquid tank 6 as illustrated in FIG. 4 but it may comprise any suitable means to allow the water to flow into the hole 2 gradually.

The pump 7 is provided with an adjusting dial 9 for adjusting the amount of the suction of the pump. This adjusting dial 9 is used to change the amount of water flowing into the bowl-like member 1 through the hole 2, thereby controlling the volume, the quality or the tone of the dripping sounds. The pump 7 further has a liquid purifier to keep the sound quality optimal which would otherwise be impaired resulting from a deterioration in the quality of the water.

The numeral 10 denotes a mesh member which is provided to cover the hole 2. This mesh member 10 functions like pebbles 21 in the conventional "Suikin-Kutsu" as illustrated in FIG. 7 and serves to diffusingly reflect the dripping sounds, to prevent the water from flowing at once (diffuse the liquid flow) and to prevent any foreign material from flowing into the bowl-like member 1.

The operation of the dripping sound generating apparatus according to this embodiment will now be described.

With the arrangement, water is first introduced into the tray 3, then it enters the bowl-like member 1 through the open end thereof and it is held within the bowl-like member 1. A suitable amount of water is also put into the liquid tank 6. Then, the pump 7 is powered on and the adjusting dial 9 is operated to adjust the overflow amount from the liquid tank 6. The water overflowing from the liquid tank 6 gradually enters the bowl-like member 1 through the mesh member 10, and then the water holds to the ceiling portion of the bowl-like member 1 and drips onto the water retained in the tray 3. At this time, dripping sounds are generated. The dripping sounds are diffusedly reflected by the mesh member 10 and emitted outside through the hole 2. As the water is automatically supplied to the liquid tank 6 by the pump 7, dripping sounds, to wit, water harp sounds, can be enjoyed continuously. The operation of the pump 7 may be made continuous or intermittent.

The dripping sound generating apparatus as described above provides not only water harp sounds enjoyable indoors but also ornamental effects. The tone and quality of the water harp sounds can be maintained more positively by periodical cleaning of the apparatus. The tone is rather high in a season when a water temperature is low and rather low in a season when the water temperature is high.

Figure 5:
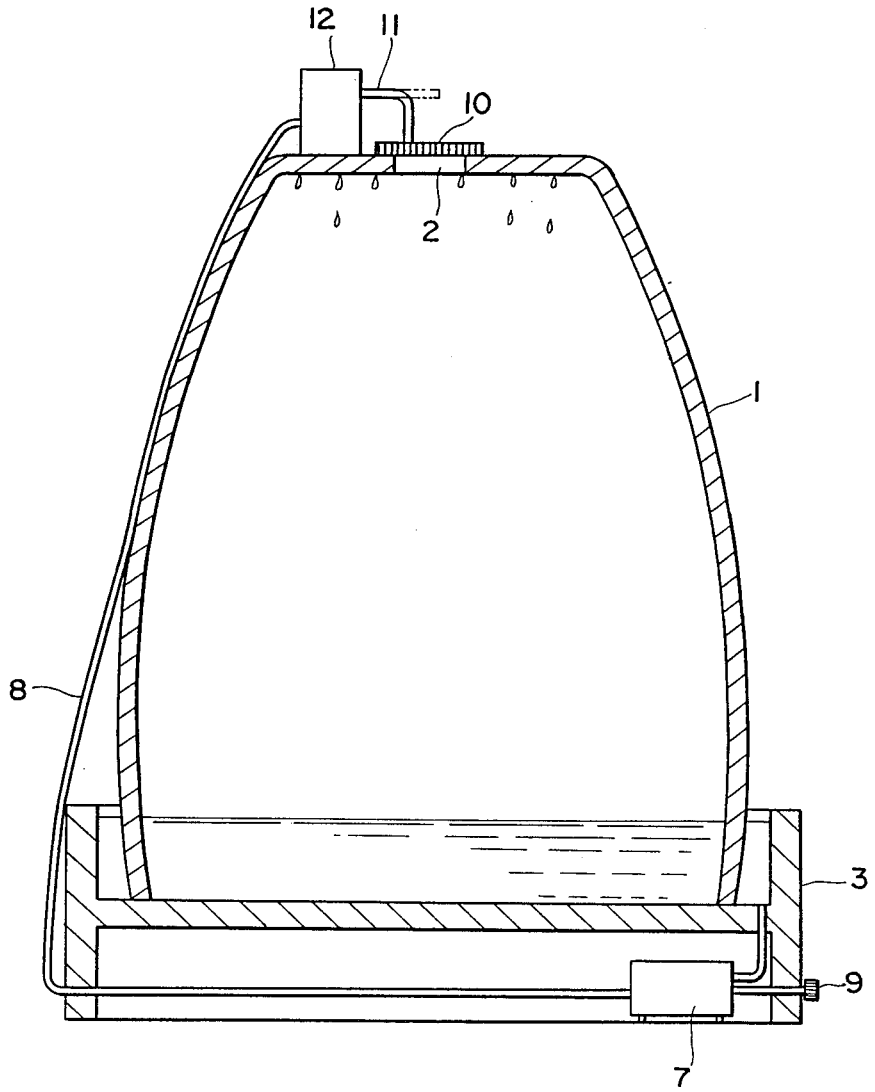
FIG. 5 is a vertically sectional view of a modified form of the dripping sound generating apparatus of FIG. 4.

FIG. 5 is a vertical sectional view of a modified dripping sound generating apparatus according to the second embodiment as described above. The same or like parts and portions are denoted by the same numerals.

The dripping sound generating apparatus as illustrated in FIG. 5 comprises a tray 3 having a raised bottom. The pump 7 is installed under the bottom and a liquid tank or reservoir 12 provided with a water supplying pipe is mounted on the top of the bowl-like member 1. The liquid supplying pipe 11 may be led directly onto the mesh member 10 as illustrated by a solid line in FIG. 5 or may be projected as illustrated by a phantom line in FIG. 5. In the latter case, water is dripped onto the mesh member 10.

The formation of the bowl-like member 1, such as a size, the configuration (4' in FIG. 4) of the inner wall, a size of the hole 2, a shape, etc. is similar to that of the foregoing embodiments.

With this arrangement, water is circulated by means of the pump 7 so that the water is led from the liquid tank 12 into the bowl-like member 1 through the mesh member 10 and the hole 2 and dripped from the ceiling to generate sounds.

Figure 6:
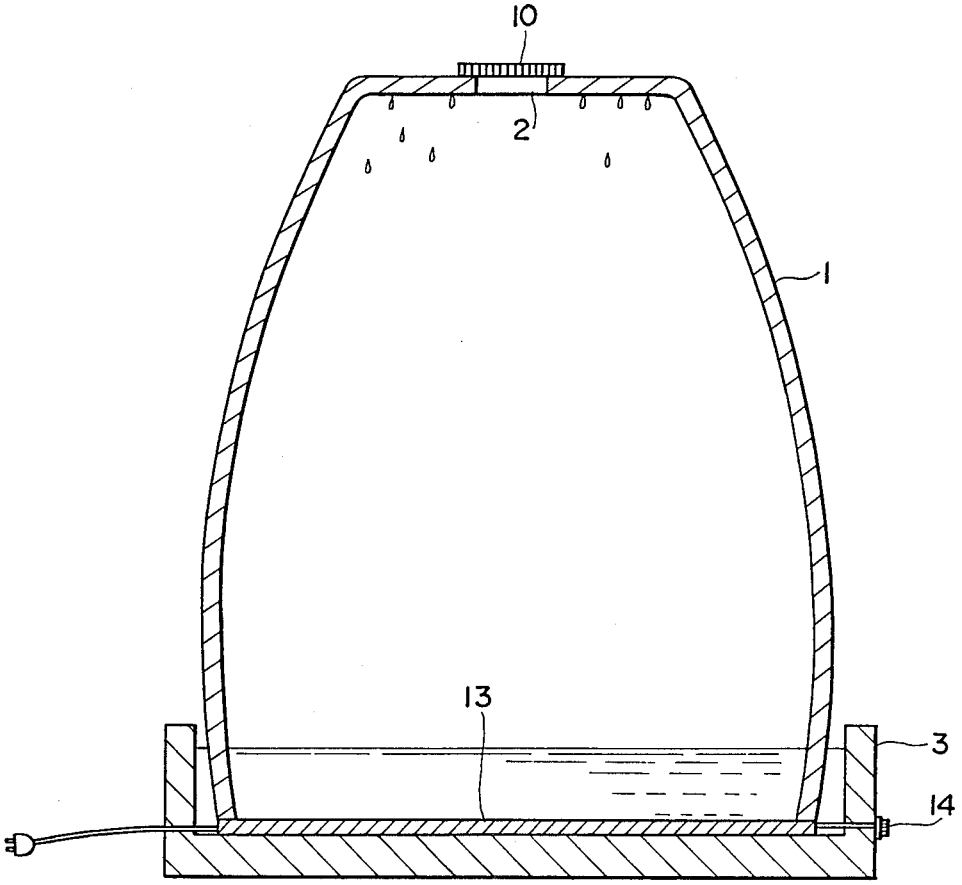
FIG. 6 is a vertically sectional view of a still another form of a dripping sound generating apparatus embodying the present invention.

FIG. 6 is a vertically sectional view of the dripping sound generating apparatus according to a third embodiment of the present invention. In this figure, the same and parts and portions are denoted by the numerals.

The dripping sound generating apparatus has a dripping means which comprises an electric panel heater 13 (AC 100 V) interposed between the tray 3 and the bowl-like member 1. Water retained in the tray 3 is evaporated by the electric panel heater 13 and water vapor thus generated sticks to the ceiling portion of the bowl-like member holds thereto in the form of water drops. The drops sticking to the ceiling portion fall onto the water retained in the tray 3, thereby generating dripping sounds. The evaporation or water drop generating amount is controlled by an adjusting dial 14 for the electric panel heater 13.

The formation of the bowl-like member 1, such as a size of the hole 2 and configuration of the member 1, is substantially the same as that of the preceding embodiment. However, this third embodiment the ceiling portion of the bowl-like member 1 may be finished either smooth or corrugated. In this embodiment, the mesh member 10 functions only to diffusingly echo or resonate the dripping sounds.

The operation of the dripping sound generating apparatus according to the present embodiment will now be described.

First, water is charged into the tray 3 and the water is introduced into the bowl-like member 1 through the open end thereof and retained at the bottom portion thereof. Then, the electric panel heater 13 is powered on. As a result of this, a portion of the water retained at the bottom portion of the bowl-like member 1 is evaporated to move upward as water vapor and becomes water drops on the ceiling portion of the bowl-member. The water drops then fall and hit the surface of the water retained at the bottom portion of the bowl-like member 1 to generate dripping sounds.

As water vapor is generated by a temperature difference between the inside and the outside of the bowl-like member 1, it is difficult to control the initiation of the dripping sounds. However, once the electric panel heater is connected to a power source, then water harp sounds can be enjoyed for a long time. The dripping sound generating apparatus of the present embodiment also has an ornamental effect. In the present embodiment, since the water temperature is always rather high, water harp sounds generated have a relatively low tone.

Although the apparatus according to the embodiments as illustrated in FIGS. 4 to 6 are suitably used indoors, it may of course be installed outdoor, if desired.

The present invention is not limited to the embodiments as described above and it may include the following changes and modifications.

(1) The open of the bowl-like member is closed to form a closed dripping sound echoing or resonating member (the bowl-like member and the tray are formed integrally with each other). In this case, a separate tray is not needed. If the electric panel heater is used as element of the dripping means, the heater is preliminarily mounted at an inside bottom portion of the echoing or resonating member in the production of the apparatus.

(2) The dripping sound echoing or resonating member is comprised of a member having a cavity therein other than a bowl-like member such as a pot, urn, etc.

(3) A capillary action is utilized to provide a dripping means. For example, a capillary tube having a low end and a high end is suspended within the dripping sound echoing or resonating member (a lower end portion of the capillary tube is in contact with the water retained at the low portion of the member). With this arrangement, if the low end portion of the capillary tube is locally heated by 1° or 2° C., the water rises in the tube by the capillary action and it falls in the form of drops from the high end of the tube. Thus, dripping sounds can be generated.

(4) A liquid other than water is used to form liquid drops.

(5) With the arrangement having a system for circulating a liquid retained at the lower portion of the dripping sound echoing or resonating member, the circulating amount of the liquid is controlled continuously or randomly to vary the dripping amount.

What is claimed is:

1. A dripping sound generating apparatus, which comprises:

(a) a dripping sound echoing or resonating member having a cavity therein and a top portion which has a hole therein, said hole communicating an outside of said member with said cavity so that a liquid is allowed to drip inside said member to generate dripping sounds therein which are to be heard outside said member;

(b) means for positively retaining the liquid having dripped inside said member; and (c) means for recycling the liquid having dripped so that the liquid is allowed to drip repeatedly.

2. A dripping sound generating apparatus according to claim 1, wherein said dripping sound echoing or resonating member is an inverted-bowl like member having an opening at a bottom thereof, and said means for positively retaining the liquid in a tray-like member which accepts said member at the bottom opening thereof.

3. A dripping sound generating apparatus according to claim 1, which further comprises first liquid paths for guiding the liquid to said hole on an outside surface of said top portion of said member, said first liquid paths being formed in order for the liquid to reach said hole therethrough over a period of time, thereby facilitating to form liquid drops for dripping.

4. A dripping sound generating apparatus according to claim 2, which further comprises first liquid paths for guiding the liquid to said hole on an outside surface of said top portion of said member, said liquid paths being formed in order for the liquid to reach said hole therethrough over a period of time, thereby facilitating to form liquid drops for dripping.

5. A dripping sound generating apparatus according to claim 1, which further comprises second liquid paths for guiding the liquid from said hole on an inside surface of said top portion of said member, said liquid paths being formed in order for the liquid having entered said member to disperse and spread inside said member.

6. A dripping sound generating apparatus according to claim 2, which further comprises second liquid paths for guiding the liquid from said hole on an inside surface of said top portion of said member, said liquid paths being formed in order for the liquid having entered said member to disperse and spread inside said member.

7. A dripping sound generating apparatus according to claim 1, wherein said means for recycling the liquid having dripped comprises a liquid circulating pump system having a suction inlet for taking in the retained liquid therethrough and a delivery outlet disposed on said member so that a recycled liquid coming out from said delivery outlet reenters said member through said hole for repeated dripping.

8. A dripping sound generating apparatus according to claim 2, wherein said means for recycling the liquid having dripped comprises a liquid circulating pump system having a suction inlet for taking in the retained liquid therethrough and a delivery outlet disposed on said member so that a recycled liquid coming out from said delivery outlet reenters said member through said hole for repeated dripping.

9. A dripping sound generating apparatus according to claim 1, wherein said means for recycling the liquid having dripped comprises an electric heating element disposed in said member for evaporating the liquid retained so that evaporated liquid condenses on a ceiling of said member and redrips inside said member.

10. A dripping sound generating apparatus according to claim 2, wherein said means for recycling the liquid having dripped comprises an electric heating element disposed in said member for evaporating the liquid retained so that evaporated liquid condenses on a ceiling of said member and redrips inside said member.

11. A dripping sound generating apparatus according to claim 1, wherein said means for recyling the liquid having dripped comprises a capillary tube, having a low end and a high end, disposed in said member so that the liquid retained enters said capillary tube from said low end, rises in said tube, and comes out from said high end for redripping.

12. A dripping sound generating apparatus according to claim 2, wherein said means for recyling the liquid having dripped comprises a capillary tube, having a low end and a high end, disposed in said member so that the liquid retained enters said capillary tube from said low end, rises in said tube, and comes out from said high end for redripping.

* * * * *